United States Patent [19]

Forrest

[11] 4,278,249

[45] Jul. 14, 1981

[54] NECK EXERCISING DEVICE

[76] Inventor: Charles P. Forrest, 1306 St. Stephens Rd., Mobile, Ala. 36603

[21] Appl. No.: 87,518

[22] Filed: Oct. 23, 1979

[51] Int. Cl.[3] ..... A63B 21/00

[52] U.S. Cl. ..... 272/94; 272/132

[58] Field of Search ..... 272/132, 94, 93; 128/25 R, 76 R

[56] References Cited

U.S. PATENT DOCUMENTS

| | | | |
|---|---|---|---|
| 2,725,232 | 11/1955 | Magida | 272/132 |
| 2,791,999 | 5/1957 | Bustamante | 272/94 |
| 2,855,202 | 10/1958 | Kinne | 272/94 |
| 3,350,102 | 10/1967 | Tiernan | 273/190 R |
| 4,066,259 | 1/1978 | Brentham | 272/94 |
| 4,219,193 | 8/1980 | Newman | 272/94 |

OTHER PUBLICATIONS

The Super Neck Developer, Advertisement in Coach and Athlete Jan./Feb. 1979.

Nautilus Instruction Manual pp. 34–37, Nautilus Sports/Medical Industries, Deland, Fla.

*Primary Examiner*—Richard J. Johnson

*Attorney, Agent, or Firm*—Kerkam, Stowell, Kondracki & Clarke

[57] ABSTRACT

A neck developer capable of facilitating a complete neck exercise through frictionally-resisted pivotal movement on two axes. The neck developer is free-standing, and readily adjustable to trainees of different heights, head sizes, and strengths. The device permits neck exercise either through resisted pivotal movement on a horizontal first pivot axis effected, for example, by either side-to-side or front-to-back head motion depending upon the orientation of the trainee, through resisted pivotal movement effected by head twisting motion, or both.

23 Claims, 8 Drawing Figures

112'
110'
100'
52
98'
94'
42
88'
84'
106
34
114'
28
32
38
36
80
92
82
78
90
40
106
100
104
108
114
112
102
84
88
94
18
20
58
60
68
76
74
72
22
26
24
66
82'
78'
80'
50
48
90'
118
116
124
126
122
134
136
132
128
120
44
130
64
16
14
10

NECK EXERCISING DEVICE

BACKGROUND OF THE INVENTION

The present invention relates to a training device for developing muscles of the neck, thereby reducing the chances of serious injury in contact sports.

It has been recognized that training exercises to strengthen neck muscles reduce the chance of injury in contact sports, such as football. Additionally, neck exercises may be prescribed for rehabilitation following an injury. Accordingly, various types of neck exercising devices have previously been proposed. For example, a traction type device is proposed in the Bustamante U.S. Pat. No. 2,791,999; a harness-like device for attaching weights to the head is proposed in the Kinne U.S. Pat. No. 2,855,202; and a device for exercising neck muscles through pivotal movement resisted by a hydraulic damping device such as an automobile or motorcycle-type shock absorber is disclosed in the Brentham U.S. Pat. No. 4,066,259. With the Brentham neck exerciser, depending upon the orientation of the user with respect to the device, neck muscles may be exercised through hydraulically-resisted pivotal movement with either side-to-side or front-to-back head motion.

Nevertheless, prior to the present invention, there remained a need for a portable yet versatile neck developer which would facilitate complete exercise for the various muscles of the neck, and which readily accommodates persons of different head sizes, strengths and heights.

SUMMARY OF THE INVENTION

Accordingly, it is an object of the invention to provide a neck developer device capable of facilitating a complete neck exercise.

It is another object of the invention to provide such a neck developer which is readily adjustable to persons of different height, obviating the need for taller persons to squat, or for shorter persons to stand on boxes or stools.

It is still another object of the invention to provide a neck developer device with a convenient head clamping arrangement, readily adjustable to individual head sizes.

It is still another object of the invention to provide a neck developer which does not employ weights and pulleys, but which nevertheless provides positive and constant resistance to movement during a training exercise.

It is still another object of the invention to provide a neck developer device which accommodates exercises for developing neck muscles in every head and neck position, with movement possible in several directions, and with full 0° to 180° freedom of movement.

Briefly stated, and in accordance with one aspect of the invention, a neck exercising device includes a top assembly secured to a suitable support at the approximate height of a trainee's neck. The top assembly includes a fixed portion and a first movable portion pivotally mounted to the fixed portion on a horizontal first pivot axis generally corresponding in height to the position of the trainee's neck. A first mechanical resistance device is provided and arranged to resist pivotal movement of the first movable portion relative to the fixed portion. Preferably, the first mechanical resistance device is a brake which develops motion-resisting force by means of friction. In a preferred form, the brake comprises a pair of discs axially urged with adjustable force towards one another for frictional engagement, with a freely-floating disc of brake lining material disposed between the pair of discs.

The device includes a second movable portion having head gripping member which is pivotally mounted to the first movable portion on a second pivot axis generally perpendicular to the horizontal first pivot axis and generally in alignment with an imaginary axis passing through the trainee's neck and through the top of the trainee's head when gripped. A second mechanical resistance device, similar to the first mechanical resistance device, is arranged to resist pivotal movement of the second movable portion relative to the first movable portion.

The neck exercising device thus provided may be employed by a trainee to exercise the neck muscles through resisted pivotal movement of two distinct kinds. The first type of resisted pivotal movement is on the first pivot axis and may be effected, for example, by either side-to-side or front-to-back head motion, depending upon the precise orientation of the trainee with respect to the top assembly. In addition, neck exercise may be accomplished through resisted pivotal movement on the second pivot axis effected by head twisting motion. These two distinct types of resisted head motion may be effected either individually, or in combination, thus providing a relatively complete overall neck exercise.

In accordance with another aspect of the invention, the neck exercising device is portable in nature and includes a platform-like base adapted to be placed on a floor, and an upstanding support member secured to the base and extending upwardly therefrom. The top assembly is secured to the upstanding support member at approximately the height of the user's neck. Preferably, to accommodate trainees of differing heights, the upstanding support member is adjustable in length. In the preferred form, the upstanding support member comprises a pair of telescoping tubular members with an internal compression spring to urge the top assembly upward against the force of gravity. A suitable means is provided to fix the telescoping tubular members at any desired relative position so as to fix a desired top assembly height adjustment.

In accordance with another aspect of the invention, the particular pivot and friction brake arrangement permits 0° to 180° freedom of movement. This freedom of movement about two perpendicular axes permits a complete neck exercise.

In accordance with another aspect of the invention, the first movable portion pivotally mounted to the fixed portion comprises an upper top assembly including the second movable portion having head gripping members, with the center of gravity of the upper top assembly normally positioned above the horizontal first pivot axis. A counterweight assembly is provided and has a center of gravity normally positioned below the horizontal first pivot axis. The counterweight assembly is fixed to the upper top assembly and is of sufficient mass and dimensions to counterbalance the upper top assembly to keep the first movable portion overall in a normal upright position.

In accordance with still another aspect of the invention, as easily adjustable head gripping member comprises an elongated guide member extending generally perpendicularly to the second pivot axis, and a sliding assembly includes a collar portion loosely slidingly engaging the outer surface of the elongated guide member. A head engaging pad is attached to the collar portion, and a set screw serves as means for fixing the collar and head engaging pad to the elongated guide member at any desired position.

In accordance with still another aspect of the invention, neck exercise is facilitated through resisted head twisting motion, preferably about a generally vertical pivot axis. In particular, a neck exercising device includes a support, a movable portion having head gripping members and pivotally mounted to said support on a pivot axis generally in alignment with an imaginary axis passing through a trainee's neck and through the top of the trainee's head when gripped, and a mechanical resistance device arranged to resist pivotal movement of said movable portion relative to said support. Thus the trainee may exercise the neck muscles through resisted pivotal movement effected by head twisting motion. Preferably, the mechanical resistance device is a brake with develops motion-resisting force by means of friction.

The present invention therefore provides a neck developer having improved performance characteristics, capable of facilitating a complete neck exercise, and easily and readily adjusted to fit various individuals of different height, head size, and strength.

BRIEF DESCRIPTION OF THE DRAWINGS

While the novel features of the invention are set forth with particularity in the appended claims, the invention, both as organization and content, will be better understood and appreciated, along with other objects and features thereof, from the following detailed description taken in conjunction with the drawings, in which:

DETAILED DESCRIPTION OF THE PREFERRED EMBODIMENT

Figure 1:
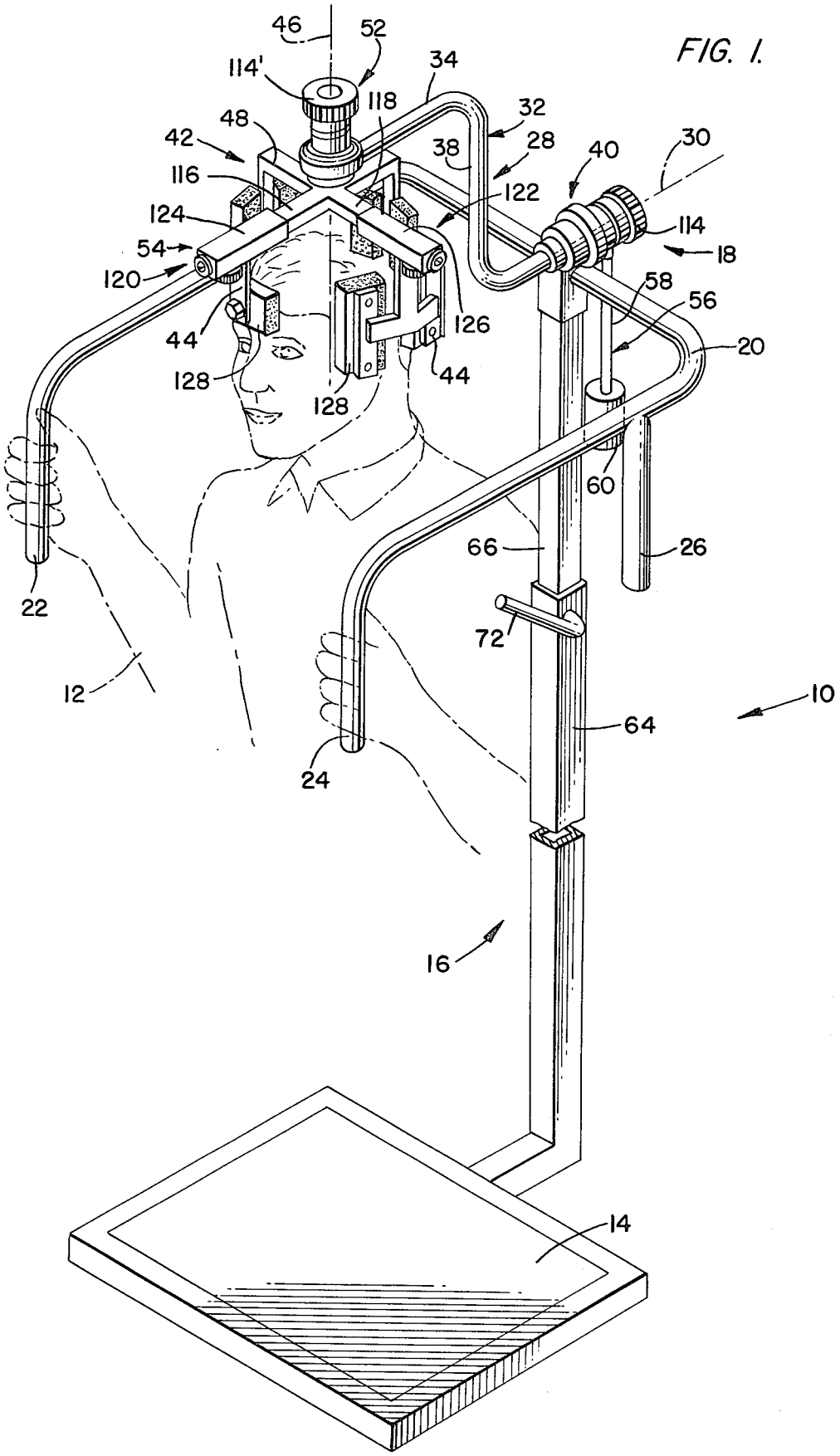
FIG. 1 is an overall perspective view of the present neck developer with a trainee depicted in phantom lines positioned for either side-to-side neck exercise, twisting neck exercise, or both.

Referring first to FIG. 1, a neck exercising device, generally designated 10, is shown in solid lines, with a trainee 12 shown in phantom lines in position ready to begin a neck exercise sequence. The neck exercising device 10 of the invention includes a platform-like base 14 adapted to be placed on a floor, and upon which the trainee 12 stands during use. An upstanding support member 16 is secured to the base 14, and extends upwardly therefrom.

At approximately the height of the neck of the trainee 12, a top assembly, generally designated 18, is secured to the upstanding support member 16. The top assembly 18 includes a fixed portion 20 with hand grips 22, 24 and 26 for the trainee 12 to stabilize the torso while exercising neck muscles. The hand grips 22, 24 and 26 are used in pairs, depending upon the particular position of the trainee 12 for a particular neck exercise.

The top assembly 18 additionally includes a first movable portion 28 pivotally mounted to the fixed portion 20 on a horizontal first pivot axis 30 generally corresponding in height to the position of the neck of the trainee 12. More particularly, the first movable portion 28 includes a tubular supporting member 32 comprising parallel end portions 34 and 36 joined by an intermediate portion 38. The end portion 36 is mounted to the fixed portion 20 through a first bearing and brake assembly, generally designated 40, and described hereinafter in greater detail with particular reference to FIGS. 2 and 3. As is further described hereinafter with reference to FIGS. 2 and 3, the first bearing and brake assembly 40 includes a first mechanical resistance device arranged to resist pivotal movement of the first movable portion 28 relative to the fixed portion 20.

A second movable portion, generally designated 42, includes head gripping members 44 and is pivotally mounted to the first movable portion 28 on a second pivot axis 46 generally perpendicular to the horizontal first pivot axis 30 and generally in alignment with an imaginary axis passing through the neck of the trainee 12 and through the top of the head of the trainee 12 when gripped. In the FIG. 1 position, before training exercises have begun, the second axis 46 is vertical. More particularly, the second movable portion 42 includes a main cross-shaped brace 48 including a shaft 50 (FIG. 2) which is mounted to the first movable portion 28 through a second bearing and brake assembly, generally designated 52. The second bearing and brake assembly 52 is substantially identical to the first bearing and brake assembly 40, and includes a second mechanical resistance device, described in greater detail hereinafter with particular reference to FIGS. 2 and 3, arranged to resist pivotal movement of the second movable portion 42 relative to the first movable portion 28.

Figure 8:
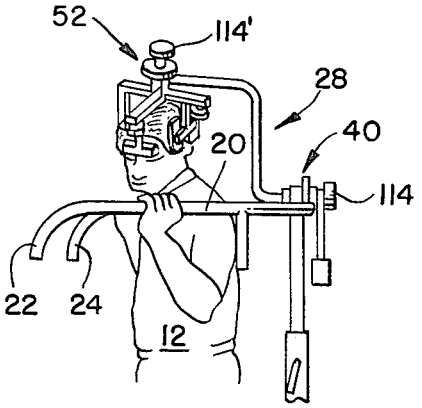
FIG. 8 depicts the neck exerciser in use to resist head and neck motion sideways to the left with the head of the trainee also tilted forward at approximately a 45° angle.

Thus, a particular feature of the present invention is the two separate pivot axes 30 and 46, preferably perpendicular, which permit a wide range of resisted motion. Further the device 10, as a practical matter, does not limit the range of pivotal movement. A full 180° is permitted. In particular, and as is described in greater detail hereinafter with particular reference to FIGS. 4–8, the neck exercising device 10 generally permits the trainee 12 to exercise the neck muscles through resisted pivotal movement on the horizontal first pivot axis 30 effected, for example, by either side-to-side (FIG. 6) or front-to-back (FIGS. 4 and 5) head motion, depending on the precise orientation of the trainee with respect to the top assembly 18. The device 10 also permits exercise to the neck muscles through resisted pivotal movement on the second pivot axis 46 effected by head twisting motion (FIG. 7). These motions may also be effected simultaneously (FIG. 8).

In FIG. 1, the first movable portion 28 may be seen to include an upper top assembly 54 and a counterweight assembly 56. The upper top assembly 54 includes the second movable portion 42 having head gripping members 44, and the center of gravity of the upper top assembly 54 is normally positioned above the horizontal first pivot axis 30. The counterweight assembly 56 comprises a lever arm 58 and a counterweight 60, and is fixed to the upper top assembly 54. The counterweight assembly 56 is of sufficient mass and dimensions to counterbalance the upper top assembly 54 to keep the first movable portion 28 overall in a normal upright position as is shown in FIG. 1.

Another particular feature of the present invention is a height adjustment to accommodate trainess of differing heights. As may be seen in the exploded view of FIG. 2, the upstanding support member 16 is adjustable in length so as to vary the height of the top assembly 18 to accommodate trainees 12 of different heights. More particularly, the upstanding support member 16 includes telescoping members 64 and 66 having an internal compression spring 68 to urge the top assembly 18 upwards against the force of gravity. Preferably, both of the telescoping members 64 and 66 are tubular, so that the spring 68 may fit within their entire combined lengths, although it will be appreciated that only the lower telescoping member 64 actually need be tubular. The upper telescoping member 66 may be solid, or may be tubular with a closed end.

The upstanding support member 16 further includes means 70 for fixing the telescoping members 64 and 66 at any desired relative position so as to fix a desired top assembly 18 height adjustment. In the illustrated embodiments, this means 70 for fixing the members 64 and 66 at a desired relative position comprises a simple set screw-type clamp comprising a lever handle 72 threaded as at 74 for engaging a threaded bore 76 in the outer telescoping member 64. The end of the threaded portion 74 then bears against the inner telescoping member 66. However, it will be appreciated that various other position fixing devices may be employed, such as by providing a plurality of holes all the way through both members 64 and 66, and providing removable pins suitably configured to avoid interference with the compression spring 68. Similarly, it will be appreciated that the shape of the handle 72 is entirely a matter of choice, and a suitable diameter knob may as well be employed.

Figure 2:
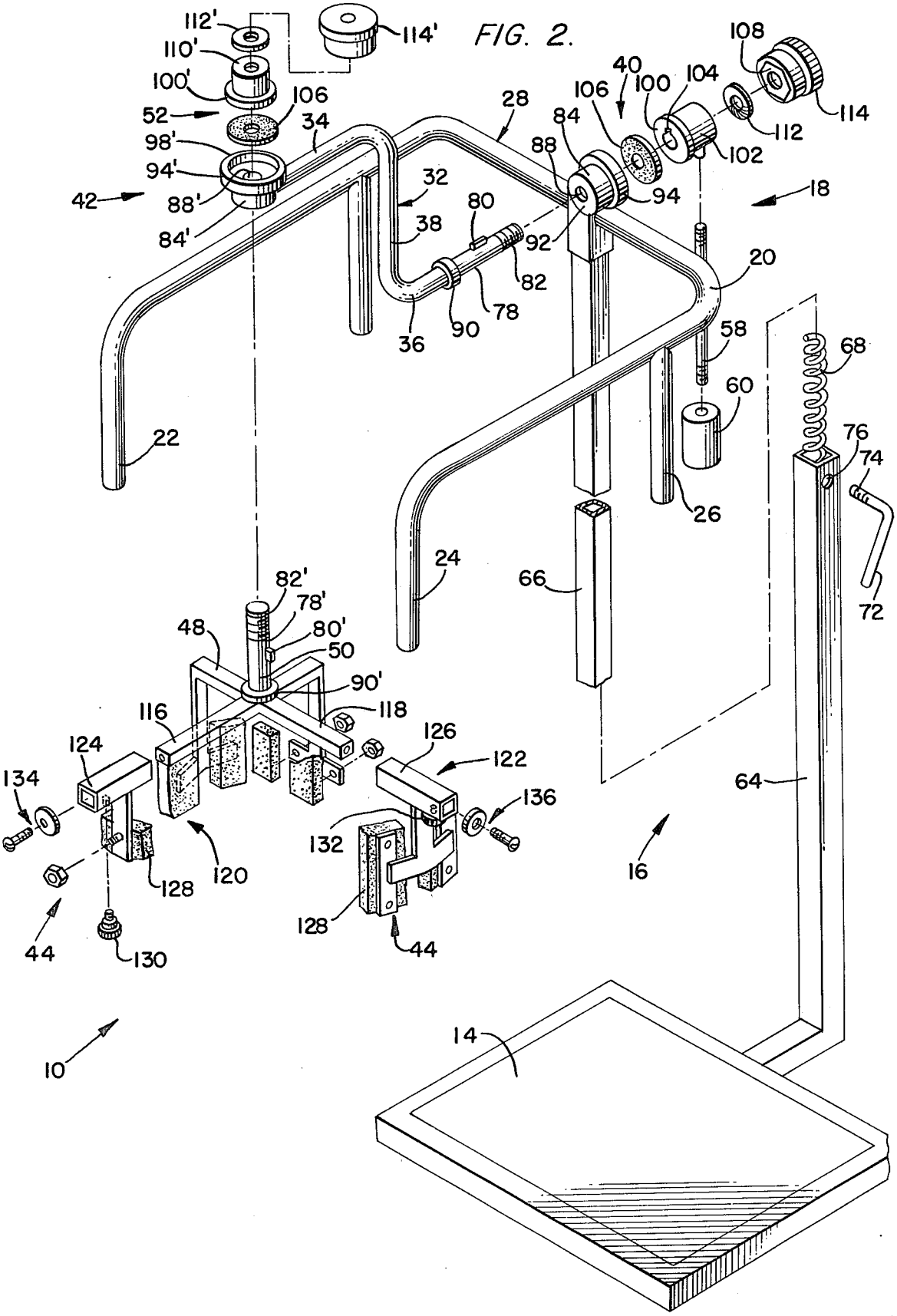
FIG. 2 is an exploded view of the neck developer device of FIG. 1, showing constructional details thereof.
Figure 3:
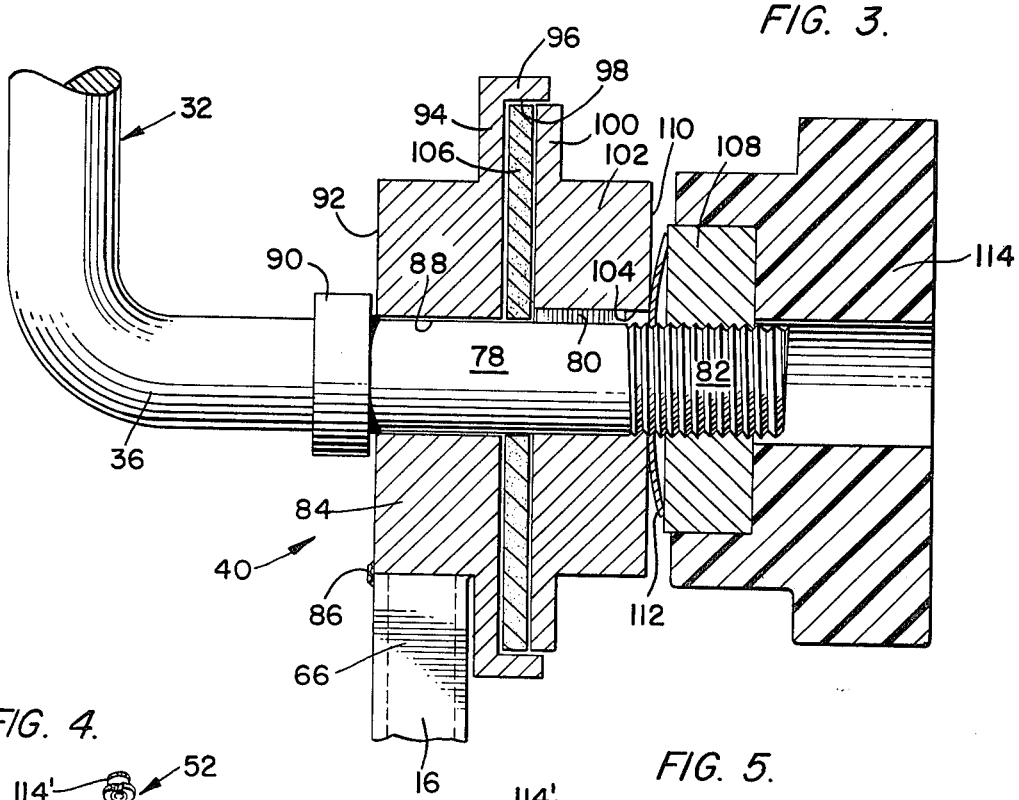
FIG. 3 is a cross sectional view showing details of one of the FIG. 1 brake assemblies.

Referring now to FIG. 3, in addition to FIGS. 1 and 2, details of the first and second bearing and brake assemblies 40 and 52 will now be described. While it is the first bearing and brake assembly 40 along the first pivot axis 30 of FIG. 1 which is particularly illustrated in FIG. 3, the second bearing and brake assembly 52 is substantially identical in construction and function, differing only in orientation. Accordingly, the following description is with particular reference to the first bearing and brake assembly 40, corresponding elements of the second bearing and brake assembly 52 being denoted by primed reference numerals in the drawings.

The end portion 36 of the tubular supporting member 32 terminates in a keyed and externally threaded shaft 78. A conventional projecting key is denoted 80, and a threaded end denoted 82.

An annular hub 84 is welded as at 86 to the upper portion of the upstanding support member 16, and more particularly the upper telescoping member 66, and has a cylindrical inner surface 88 which permits rotational pivotal movement of the shaft 78 passing therethrough. A thrust bearing collar 90 formed integrally on the shaft 78 bears axially against an end surface 92 of the hub 84, thereby preventing further movement to the right of the end portion 36 and shaft 78 with reference to the hub 84 in the orientation of FIGS. 1, 2 and 3.

Formed integrally with the hub 84 is a stationary brake disc 94 having a circumferential flange 96 defining a recess 98.

Axially urged towards the stationary brake disc 94 is a movable brake disc 100 having an integral hub 102 including a slot 104 engaging the projecting key 80 of the shaft 78 so that the movable brake disc 100 rotates with the shaft 78. The key 80 and slot 104 arrangement is such that, while the shaft 78 and hub 102 rotate together, they are free to move axially relative to each other, permitting adjustment of the force urging the brake discs 94 and 100 towards each other. It will be appreciated that any conventional splined shaft arrangement may be substituted for the projecting key 80 and the slot 104. However, the particular configuration illustrated has been found to be simple, yet effective.

Disposed between the pair of discs 94 and 100 is a freely-floating disc 106 of brake lining material to enhance the frictional characteristics of the bearing and brake assembly 40. As may be seen from FIGS. 1 and 3, in the assembled position the disc 106 fits wholly within the recess 98 and is thus concealed from view.

To complete the bearing and brake assembly 40, a nut 108 threadably engages the threaded end 82 of the shaft 78 and bears axially against the end surface 110 of the movable hub 102 through a concave spring washer 112 which is beneficial to the force adjustment action. Means for rotating the adjustment nut 108 comprises a molded plastic knob or handle 114, although other types of handles 114 may equally well be employed.

While the nut 108 is shown engaging threads 82 on the outer surface of the shaft 78, it will be appreciated that the shaft 78 may equally as well have an internally threaded bore formed in the end thereof, with a suitable flanged bolt threaded therein instead of the nut 108. However, the illustrated construction is the preferred one in that greater thread surface is provided, minimizing the possibility of stripping the threads.

In the operation of the bearing and brake assembly 40, it will be appreciated that, as the nut 108 is rotated relative to the threaded shaft portion 82, the brake discs 94 and 100 are urged axially towards each other and towards the intermediate brake lining material 106 with adjustable force, and that the rotational force required to overcome the frictional force therebetween will accordingly be varied. It has been found that this particular brake configuration, particularly the frictional force aspect thereof, is particularly beneficial in the context of an exercise machine. In particular, as is known, the motion-opposing force of friction is reasonably independent of relative speed with which the engaging surfaces move. Thus the force resisting the motion of the trainee is relatively independent of speed, closely approximating the characteristics of motion resisted by weights, without requiring the attendant complexity of cables, pulleys and the like. Additionally, the adjustment is relatively convenient. Further, the bearing and brake assembly 40, as well as the corresponding bearing and brake assembly 52, permits complete freedom of pivotal movement, of at least 180°.

Another feature of the present invention is the particular way in which adjustability of the head gripping members 44 is accomplished, as will now be described with reference to FIGS. 1 and 2. In FIGS. 1 and 2, a head gripping assembly comprises the previously-mentioned main brace 48, which more particularly comprises two elongated guide members 116 and 118 extending generally perpendicularly to the second pivot axis 46. Although the head of the trainee 12 is generally supported at four points corresponding to the four arms of the main brace 48, it is only required that two of these points, be radially adjustable with respect to the second pivot axis 46.

Associated with each of the elongated guide members 116 and 118 is a respective sliding assembly generally designated 120 and 122, and more particularly including collar portions 124 and 126 loosely slidably engaging the outer surfaces of the respective elongated guide members 116 and 118. Head engaging pads 128 are attached to the collar portions 124 and 126. Set screw and handle assemblies 130 and 132 comprise means for fixing the collar portions 124 and 126 and head engaging pads 128 to the elongated guide members 116 and 118 in any desired position. Lastly, bolt and washer assemblies 134 and 136 serve to retain the sliding assemblies 120 and 122 on the guide members 116 and 118, respectively.

In use, the trainee 12 merely loosens the set screw and handle portions 130 and 132, slides the collar portions 124 and 126 and pads 128 towards the head for proper engagement, and then tightens the set screw assemblies 130 and 132.

Referring now to FIGS. 4–8, various in-use configurations of the inventive neck exercising device 10 are shown.

Figure 4:
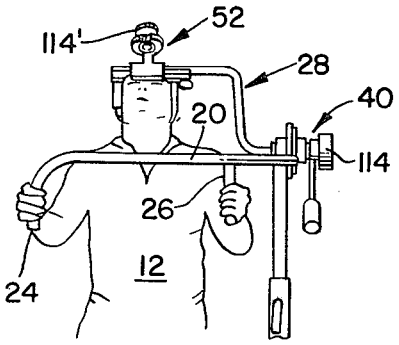
FIG. 4 is a depiction of the present neck developer in use to resist backwards head and neck motion.
Figure 5:
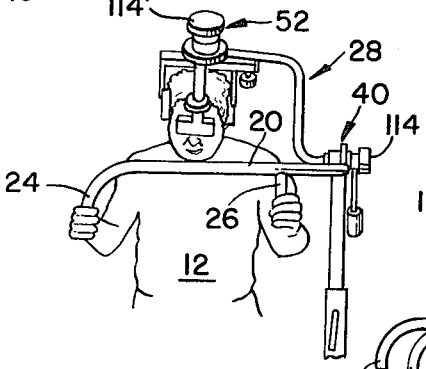
FIG. 5 is a view similar to FIG. 4 showing the neck developer in use to resist forward head and neck motion.

In FIGS. 4 and 5, the trainee is oriented with respect to the top assembly 18 utilizing the hand grips 24 and 26 such that backwards (FIG. 4) and forward (FIG. 5) movement of the head and neck causes resisted pivotal motion of the first movable portion 28 on the first pivot axis 30, with the precise degree of motion resisting force being adjusted by means of the handle 114 and screw 108 (FIGS. 2 and 3).

Figure 6:
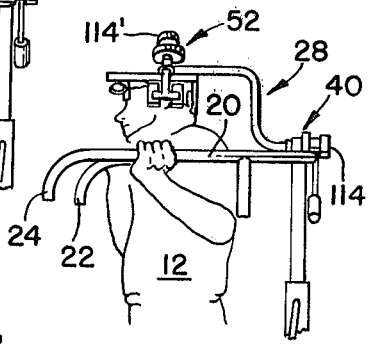
FIG. 6 is a representation showing the present neck developer in position to resist head and neck motion sideways to the right.
Figure 7:
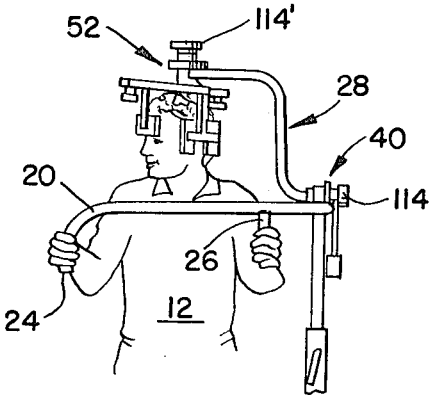
FIG. 7 is a depiction of the neck developer in use to resist head and neck twisting motion to the right.

In FIG. 6, the trainee is shown oriented with his back towards the first bearing and brake assembly 40, such that his hands may either grip the hand grips 22 and 24, or the horizontal bars of the fixed portion 20, depending upon individual preference. In FIG. 6, the trainee 12 is shown moving his head and neck to the right, with pivotal movement again being resisted by the bearing and brake assembly 40. Although not illustrated, it will be appreciated that corresponding resisted pivotal movement is effected by head movement to the left.

In FIG. 7, the trainee 12 is shown exercising head twisting muscles of the neck, by twisting the neck and head to the right, with the second bearing and brake assembly 52 providing motion resisting force. Although not illustrated, it will be appreciated that similar head twisting motion to the left may be effected.

Lastly, FIG. 8 illustrates one form of a combination movement, with the net result being a 45° left, forward neck movement. This is accomplished by a left movement on the first horizontal pivot axis 30, together with a left twisting movement on the second pivot axis 46. Depending upon the particular training excerise, these two individual movements may be accomplished either sequentially in either order, or simultaneously.

Accordingly, it will be appreciated that the present invention provides an improved neck exercising device which facilitates a complete work exercise, with resisted movement on two pivotal axis being possible. The device 10 is portable, employing a stand upon which the trainee 12 places his feet, obviating the need for a permanent attachment to the wall or the like. Moreover, the device 10 is readily adjustable to trainees of different sizes, including a height adjustment, and a head gripping assembly adjustment, both of which may be accomplished in a matter of seconds.

Additionally, the motion resisting force is preferably a frictional force, and therefore is relatively independent of speed of movement, producing a desirable training effect, similar to that which may be achieved by means of weights and belts. Moreover, complete freedom of movement over 180° for both pivotal axes, which means that there is as a practical matter no limitation imposed by the training device itself on resisted motion possible.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. A neck exercising device comprising:

a top assembly secured at the approximate height of a trainee's neck to a suitable supprt, said top assembly having:

a fixed portion, a first movable portion pivotally mounted to said fixed portion on a horizontal first pivot axis generally corresponding in height to the position of the trainee's neck, a first mechanical resistance device arranged to resist pivotal movement of said first movable portion relative to said fixed portion, a second movable portion having head gripping members and pivotally mounted to said first movable portion on a second pivot axis generally perpendicular to the horizontal first pivot axis and generally in alignment with an imaginary axis passing through the trainee's neck and through the top of the trainee's head when gripped, and a second mechanical resistance device arranged to resist pivotal movement of said second movable portion relative to said first movable portion;

whereby the trainee may exercise the neck muscles through resisted pivotal movement on the horizontal first pivot axis effected, for example, by either side-to-side or front-to-back head motion depending on the precise orientation of the trainee with respect to said top assembly, as well as through resisted pivotal movement on the second pivot axis effected by head twisting motion.

2. A neck exercising device according to claim 1, wherein said top assembly fixed portion includes hand grips for the trainee to stabilize the torso while exercising neck muscles.

3. A neck exercising device according to claim 1, wherein each of the pivotal mounts is free to pivot through at least 180°.

4. A neck exercising device according to claim 1, wherein said mechanical resistance devices are brakes which develop motion-resisting force by means of friction.

5. A neck exercising device according to claim 4, wherein said brakes comprise a pair of discs axially urged towards one another for frictional engagement.

6. A neck exercising device according to claim 5, wherein the force urging said pair of discs axially towards one another is adjustable.

7. A neck exercising device according to claim 5, wherein said brakes further comprise a freely-floating disc of brake lining material disposed between said pair of discs.

8. A neck exercising device according to claim 1, wherein said first movable portion pivotally mounted to said fixed portion comprises:

an upper top assembly including said second movable portion having head gripping members, the center of gravity of said upper top assembly normally being positioned above the horizontal first pivot axis; and a counterweight assembly having a center of gravity normally positioned below the horizontal first pivot axis, said counterweight assembly being fixed to said upper top assembly and of sufficient mass and dimensions to counterbalance said upper top assembly to keep said first movable portion overall in a normal, upright position.

9. A neck exercising device according to claim 1, wherein at least one of said head gripping members is adjustable and comprises:

an elongated guide member extending generally perpendicular to the second pivot axis;

a sliding assembly including a collar portion loosely slidably engaging the outer surface of said elongated guide member, a head-engaging pad attached to said collar portion, and means for fixing said collar and head-engaging pad to said elongated guide member by any desired position.

10. A neck exercising device according to claim 1, which further comprises:

a platform-like base adapted to be placed on a floor; and an upstanding support member secured to said base and extending upwardly therefrom;

said top assembly being secured to said upstanding support member at approximately the height of the trainee's neck.

11. A neck exercising device according to claim 10, wherein said upstanding support member is adjustable in length so as to vary the height of said top assembly to accommodate trainees of different height.

12. A neck exercising device according to claim 11, wherein said upstanding support member comprises a pair of telescoping members with an internal compression spring to urge said top assembly upward against the force of gravity.

13. A neck exercising device according to claim 12, wherein said upstanding support member further comprises means for fixing said telescoping members at any desired relative position so as to fix a desired top assembly height adjustment.

14. A neck exercising device comprising:

a platform-like base adapted to be placed on a floor;

an upstanding support member secured to said base and extending upwardly therefrom; and a top assembly secured to said upstanding support member at approximately the height of a trainee's neck, said top assembly having a fixed portion, a first movable portion pivotally mounted to said fixed portion on a horizontal first pivot axis generally corresponding in height to the position of the trainee's neck, a first mechanical resistance device arranged to resist pivotal movement of said first movable portion relative to said fixed portion, a second movable portion having head gripping members and pivotally mounted to said first movable portion on a second pivot axis generally perpendicular to the horizontal first pivot axis and generally in alignment with an imaginary axis passing through the trainee's neck and through the top of the trainee's head when gripped, and a second mechanical resistance device arranged to resist pivotal movement of said second movable portion relative to said first movable portion;

whereby the trainee may exercise the neck muscles through resisted pivotal movement on the horizontal first pivot axis effected, for example, by either side-to-side or front-to-back head motion depending on the precise orientation of the trainee with respect to said top assembly, as well as through resisted pivotal movement on the second pivot axis effected by head twisting motion.

15. A neck exercising device according to claim 14, wherein said top assembly fixed portion includes hand grips for the trainee to stabilize the torso while exercising neck muscles.

16. A neck exercising device according to claim 14, wherein each of the pivotal mounts is free to pivot through at least 180°.

17. A neck exercising device according to claim 14, wherein said mechanical resistance devices are brakes which develop motion-resisting force by means of friction.

18. A neck exercising device according to claim 17, wherein said brakes comprise a pair of discs axially urged towards one another for frictional engagement.

19. A neck exercising device according to claim 18, wherein the force urging said pair of discs axially towards one another is adjustable.

20. A neck exercising device according to claim 18, wherein said brakes further comprise a freely-floating disc of brake lining material disposed between said pair of discs.

21. A neck exercising device according to claim 14, wherein said upstanding support member is adjustable in length so as to vary the height of said top assembly to accommodate trainees of different height.

22. A neck exercising device according to claim 14, wherein said first movable portion pivotally mounted to said fixed portion comprises:

an upper top assembly including said second movable portion having head gripping members, the center of gravity of said upper top assembly normally being positioned above the horizontal first pivot axis; and a counterweight assembly having a center of gravity normally positioned below the horizontal first pivot axis, said counterweight assembly being fixed to said upper top assembly and of sufficient mass and dimensions to counterbalance said upper top assembly to keep said first movable portion overall in a normal, upright position.

23. A neck exercising device according to claim 14, wherein at least one of said head gripping members is adjustable and comprises:

an elongated guide member extending generally perpendicularly to the second pivot axis; and a sliding assembly including a collar portion loosely slidably engaging the outer surface of said elongated guide member, a head-engaging pad attached to said collar portion, and means for fixing said collar and head-engaging pad to said elongated guide member at any desired position.

* * * * *